United States Patent [19]

Schmid et al.

[11] Patent Number: 4,719,084

[45] Date of Patent: Jan. 12, 1988

[54] MIXTURES OF FATTY ACID AMMONIUM SALTS WITH ANTIFOAMING AND ANTICORROSION ENHANCING POLYOL FATTY ACIDS OR SALTS THEREOF

[75] Inventors: Karl H. Schmid, Mettmann; Alfred Meffert, Monheim; Bert Gruber, Bedburg, all of Fed. Rep. of Germany

[73] Assignee: Henkel Kommanditgesellschaft auf Aktien, Duesseldorf, Fed. Rep. of Germany

[21] Appl. No.: 28,379

[22] Filed: Mar. 20, 1987

[30] Foreign Application Priority Data

Mar. 20, 1986 [DE] Fed. Rep. of Germany ..... 3609401

[51] Int. Cl.[4] ..... C23F 11/04

[52] U.S. Cl. ..... 422/16; 562/587; 260/398; 260/404; 260/404.5; 252/34; 252/76; 252/77; 252/117; 252/392; 252/358; 422/17

[58] Field of Search ..... 562/587; 260/398, 404, 260/404.5 Q, 404.5 R; 422/16, 17; 252/34, 76, 77, 117, 392, 358

[56] References Cited

U.S. PATENT DOCUMENTS

| | | | |
|---|---|---|---|
| 2,939,880 | 6/1960 | Montagna et al. | 562/587 X |
| 3,031,282 | 4/1962 | Andress, Jr. et al. | 252/392 X |
| 3,374,171 | 3/1968 | Davis | 252/34.7 |
| 4,207,285 | 6/1980 | Oppenlaender et al. | 252/392 |
| 4,303,543 | 12/1981 | Mansy | 252/117 |
| 4,468,338 | 8/1984 | Lindberg | 252/117 X |

*Primary Examiner*—Matthew A. Thexton

*Attorney, Agent, or Firm*—Ernest G. Szoke; Henry E. Millson, Jr.

[57] ABSTRACT

Water-soluble corrosion-inhibiting mixtures containing (a) one or more ammonium salts of fatty acids corresponding to the following general formula

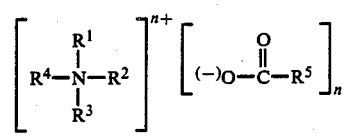

(I)

in which n=1 or 2 while $R^1$, $R^2$, $R^3$ and $R^4$ may be the same or different and represent hydrogen, unbranched or branched $C_1$–$C_6$ alkyl groups, $C_1$–$C_6$ hydroxyalkylene groups or $C_1$–$C_8$ aminoalkylene groups and $R^5$ represents $C_6$–$C_{10}$ alkyl groups, and (b) one or more polyol fatty acids and/or salts thereof corresponding to the following general formula

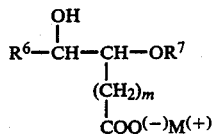

(II)

in which $R^6$ is a $C_1$–$C_{19}$ alkyl or alkylene group and $R^7$ represents an organic residue formed from a dihydroxy or polyhydroxy compound by elimination of a hydroxyl group, $M^{(+)}=H^{(+)}$, $Na^{(+)}$, $K^{(+)}$ or an ammonium ion $[R^1R^2R^3R^4N]^{n+}$, as in formula (I), and m is an integer of from 0 to 18, and to a process for preparing these water-soluble mixtures and to the use of these mixtures for inhibiting corrosion in drilling oils, cutting oils, rolling oils, grinding oils, metal-cleaning solutions, coolants and lubricants.

15 Claims, No Drawings

MIXTURES OF FATTY ACID AMMONIUM SALTS WITH ANTIFOAMING AND ANTICORROSION ENHANCING POLYOL FATTY ACIDS OR SALTS THEREOF

BACKGROUND OF THE INVENTION

1. Field of the Invention

This invention relates to water-soluble mixtures of fatty acid ammonium salts and polyol fatty acids or alkali or ammonium salts thereof, to a process for their preparation, and to their use as corrosion inhibitors in aqueous systems.

2. Statement of Related Art

Corrosion problems repeatedly arise in industrial processes for machining metal surfaces, for example by drilling, cutting, rolling or grinding, and for cleaning metals. In the above processes and also in industrial cleaning processes taking place in the presence of water and water-containing liquid mixtures, metals susceptible to corrosion, primarily iron or iron-containing alloys, come into contact with aqueous industrial cleaning preparations, cooling waters, cooling lubricants for machining metals, etc. and, under adverse conditions, are corroded. On the one hand, this shortens the life of the machinery involved; on the other hand, in processes where the metal surfaces are subsequently to be further treated and, optionally, provided with anti-corrosion coatings, elaborate intermediate treatments have to be applied to ensure that the already corroded metal surfaces are free from corrosion for the following processes.

Amine salts and alkanolamine salts of maleamic acid and derivatives thereof are known from German Application No. 11 49 843 and from European Pat. No. 0 002 780 as corrosion inhibitors for aqueous systems. Compounds such as these show good to adequate solubility in water for use in aqueous systems, depending on the substituents, and a satisfactory corrosion-inhibiting effect for practical purposes, but are attended by the disadvantage that they foam very heavily. This is observed above all when these inhibitors are added to cooling waters or to cooling lubricants. Accordingly, a foam inhibitor had to be added when using these compounds. In addition, it was found that these compounds are sometimes very sensitive to variations in water hardness.

Alkanolamine salts of alkenylsuccinic acids are known as corrosion inhibitors for aqueous systems from German Application No. 29 43 963. In addition, amine salts of $C_6$–$C_9$ fatty acids are disclosed as water-soluble corrosion inhibitors in U.S. Pat. No. 3,374,171. In this invention, fatty acids, such as caproic acid, caprylic acid, heptanoic acid and pelargonic acid, are neutralized with alkanolamines and mixed with polyoxyalkylene glycols.

The neutralization product of di-n-butylamine with a 1:1-mixture of caprylic acid and capric acid shows a better corrosion-inhibiting effect than the fatty acids neutralized with alkanolamines. However, this product has the disadvantage of an extremely unpleasant odor. Accordingly, in view of the large surfaces which are treated with corrosion inhibitors of the type in question, the surrounding atmosphere is polluted by that odor to an unacceptable extent.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to provide a water-soluble corrosion inhibitor which effectively inhibits corrosion on metallic surfaces of iron or iron-containing alloys coupled with a minimal tendency towards foaming and a minimal sensitivity to variations in water hardness. In addition, the invention seeks to guarantee that no odor pollution is caused by the ingredients of the corrosion inhibitor.

The present invention relates to water-soluble corrosion-inhibiting mixtures containing (a) one or more ammonium salts of fatty acids corresponding to the following general formula

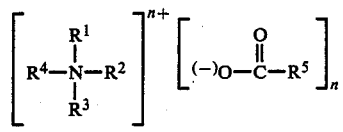

(I)

in which n=1 or 2 while $R^1$, $R^2$, $R^3$ and $R^4$ may be the same or different and represent hydrogen, unbranched $C_1$–$C_6$ alkyl groups, $C_1$–$C_6$ hydroxyalkylene groups or $C_1$–$C_8$ aminoalkylene groups and $R^5$ represents unbranched or branched $C_6$–$C_{10}$ alkyl groups, in quantities of from 10 to 90% by weight, based on the total weight of (a) plus (b), and (b) one or more polyol fatty acids and/or salts thereof corresponding to the following general formula

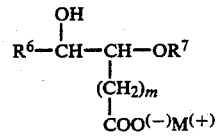

(II)

in which $R^6$ is a straight-chain or branched $C_1$–$C_{19}$ alkyl or alkenyl group and $R^7$ is an organic residue formed from a dihydroxy or polyhydroxy compound by elimination of a hydroxyl group, $M^{(+)}=H^{(+)}$, $Na^{(+)}$, $K^{(+)}$ or an ammonium ion $[R^1R^2R^3R^4N]^{n+}$, as in formula (I), and m is an integer of from 0 to 18, in quantities of from 10 to 90% by weight, based on the total weight of (a) plus (b).

The present invention also relates to a process for the preparation of these mixtures in which unsaturated fatty acids corresponding to the following general formula $$R^6—CH=CH—(CH_2)_m—COOY \quad (III)$$

in which $R^6$ and m are as defined above and Y is hydrogen, or derivatives thereof, in which Y is the residue of a monohydric or polyhydric alcohol, such as for example glycerol or methanol, are epoxidized, the resulting epoxide is reacted with a dihydroxy or polyhydroxy compound corresponding to the following general formula $$R^7OH \quad (IV)$$

in which $R^7$ represents an organic residue formed from a dihydroxy or polyhydroxy compound by elimination of a hydroxyl group, the derivatives of the polyol fatty acid obtained are saponified with bases corresponding to the general formula $M^{(+)}OH^{(-)}$, in which $M^{(+)}$ is as defined above, or with an acid, and the polyol fatty acid obtained and/or its salts corresponding to general formula (II) and optionally other polyol fatty acids corresponding to the above general formula (II) are mixed with one or more ammonium salts of fatty acids corresponding to general formula (I) above in a ratio by weight of from 10:1 to 1:10, and the resulting mixture optionally diluted with water to form aqueous solutions thereof.

The present invention also relates to the use of the water-soluble mixtures of fatty acid ammonium salts and polyol fatty acids and/or salts thereof as corrosion inhibitors in drilling oils, cutting oils, rolling oils, grinding oils, metal-cleaning solutions, coolants and lubricants.

As disclosed above, the water-soluble corrosion-inhibiting mixtures of the invention contain as one of their components one or more ammonium salts of fatty acids corresponding to general formula (I) above. In formula (I), n=1 or 2 and two or more of the substituents $R^1$, $R^2$, $R^3$ and $R^4$ can be the same, or all the substituents can be different from one another. They can represent hydrogen or unbranched or branched $C_1$–$C_6$ alkyl groups, $C_1$–$C_6$ hydroxyalkylene groups or, where n=2, $C_1$–$C_8$ aminoalkylene groups. The alkyl groups can be methyl, ethyl, n-propyl, i-propyl, n-butyl, i-butyl, tert.-butyl, and also n-pentyl or n-hexyl groups and branched isomers thereof. Suitable hydroxyalkylene groups are hydroxymethylene or hydroxyethylene groups or higher homologs thereof containing from 3 to 6 C-atoms in the alkylene group. Suitable aminoalkylene groups are aminomethylene, aminoethylene or aminopropylene groups or higher homologs thereof containing from 4 to 8 C-atoms or corresponding aminoalkylene groups substituted at the N-atom by $C_1$–$C_3$ alkyl groups.

Preferred are compounds (I) with n=1 in which one substituent in the ammonium cation is a $C_1$–$C_6$ alkyl group while the remaining substituents are hydrogen, or to compounds (I) in which two of these substituents represent a $C_3$ or $C_4$ alkyl group while the other two substituents are hydrogen. Also preferred are compounds (I) with n=2 in which one of the substituents in the ammonium cation is an aminoalkylene group corresponding to the above definition and which therefore contain two cationic N-atoms; one of the other two substituents is a $C_1$–$C_3$ alkyl group while the other two substituents are hydrogen.

Ammonium salts (I) with ammonium cations, in which two substituents represent an n-butyl group while the other two substituents are hydrogen, and ammonium salts (I) in which the ammonium cation is $[N,N\text{-dimethyl-1,3-propylene-diamine}]^{2+}$ have proved to be particularly effective.

The substituent $R^5$ in general formula (I) is an unbranched and/or branched $C_6$–$C_{10}$ alkyl group. Particularly suitable substituents $R^5$ are i-heptyl, i/n-octyl, i-nonyl or n-decyl. Accordingly, the ammonium salts (I) can advantageously emanate from caprylic acid, isononanoic acid or capric acid.

Mixtures of ammonium salts of two fatty acids each corresponding to general formula (I) are regarded as a preferred ammonium salt component (a). Mixtures of two ammonium salts in a ratio by weight of 1:1 have proven to be particularly successful. Mixtures of ammonium salts (I) formed from the neutralization of a mixture of 50% caprylic acid and 50% capric acid with $C_1$–$C_8$ amines, such as for example di-n-butylamine, N,N-dimethyl-1,3-propylenediamine or 2-amino-2-methyl-1-propanol, are particularly advantageous.

The water-soluble mixtures of the invention contain one or more of the ammonium salts of fatty acids corresponding to general formula (I) (component a)) in quantities of from 10 to 90% by weight, preferably from 10 to 50% by weight, based on the total weight of components (a) plus (b).

As described above, the water-soluble mixtures of the invention contain as component (b) one or more polyol fatty acids of general formula (II) and/or salts thereof. In general formula (II), $R^6$ is a straight-chain or branched-chain $C_1$–$C_{19}$ alkyl or alkylene group. Accordingly, the $R^6$ group can be a methyl, ethyl, n-propyl, i-propyl, n-butyl, i-butyl, tert.-butyl and n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl or n-nonadecyl group and also a branched isomer of the alkylene or alkyl groups given above. $C_8$–$C_{15}$ alkyl groups are preferred.

In general formula (II), m is an integer of from 0 to 18 and preferably of from 8 to 14. Compounds of general formula (II) in which the substituent $R^6$ is n-octyl and m=7 have proven to be particularly successful in practice.

In general formula (II), $R^7$ is an organic residue formed from a dihydroxy or polyhydroxy compound by elimination of a hydroxyl group. Compounds from the following group have proved to be particularly successful dihydroxy or polyhydroxy compounds: ethylene glycol, glycerol, diglycerol, propylene glycol, diethylene glycol, dipropylene glycol, trimethylol ethane, trimethylol propane, neopentyl glycol, pentaerythritol, dipentaerythritol, sorbitol, sorbitan, diethanolamine, triethanolamine, polyethylene glycol ($H(OCH_2CH_2)_nOH$ with n=1–10), polypropylene glycol $$(H(CH(CH_3)CH_2)_nOH$$

with n=1–10), propylene oxide-ethylene oxide block polymers, i.e. compounds corresponding to the formula $$HO(CH_2-CH_2-O)_y(CH(CH_3)-CH_2-O)_x(CH_2-CH_2-O)_yH$$

with $x+y=2$ to 10 and ethylene oxide-propylene oxide block polymers, i.e. compounds corresponding to the formula $$HO(CH(CH_3)-CH_2-O)_y(CH_2-CH_2-O)_x(CH(CH_3)-CH_2-O)_yH$$

with $x+y=2$ to 10.

The alkoxy group $R^7O$— in general formula (II) is formed in the course of the process of the invention described hereinafter by addition of dihydroxy or polyhydroxy compounds corresponding to formula (IV) to an epoxide of an unsaturated carboxylic acid (III).

The products corresponding to formula (II) also include mixtures of compounds in which two or more fatty acid molecules are attached to one another by a dihydroxy or polyhydroxy compound corresponding to formula (IV).

Instead of the polyol fatty acids corresponding to general formula (II) above, in which $M^{(+)}$ represents $H^{(+)}$, it is also possible to use water-soluble salts thereof, preferably alkali-metal salts, for example sodium and/or potassium salts, in which $M^{(+)}$ represents $Na^{(+)}$ and $K^{(+)}$, respectively. It is also possible with advantage to use salts (II), in which $M^{(+)}$ is an ammonium cation $[R^1R^2R^3R^4N]^{n+}$ where $R^1$, $R^2$, $R^3$ and $R^4$ and also n are as defined above. Of course, when n=2, then two polyol fatty acid anions are present.

The water-soluble corrosion-inhibiting mixtures according to the invention can contain one or more polyol fatty acids or salts thereof corresponding to general formula (II). The compounds (II) are present in total quantities of from 10 to 90% by weight and preferably in total quantities of from 50 to 90% by weight, based on the total weight of the mixture of component (a) and component (b).

The process for preparing the polyol fatty acids corresponding to general formula (II) is based on the process described in German Application No. 33 18 596. In this process, unsaturated fatty acids corresponding to the following general formula $$R^6—CH=CH—(CH_2)_m—COOY \quad (III)$$

in which $R^6$ and m are as defined above and Y is hydrogen, or derivatives thereof, in which Y is the residue of a monohydric or polyhydric alcohol, such as glycerol or methanol for example, are epoxidized using methods known for the epoxidation of double bonds. This may be done, for example, by using peroxycarboxylic acids. The epoxidation gives epoxides in which the oxirane ring assumes the position in the molecule which, in the adduct, is predetermined by the carbon atoms attached to the double bond. The epoxide obtained is then reacted with a dihydroxy or polyhydroxy compound corresponding to the following general formula $$R^7OH \quad (IV)$$

in which $R^7$ is as defined above. This can be done, for example, by reacting the epoxides with an excess of the dihydroxy or polyhydroxy compound (IV) in the presence of an acid as catalyst, resulting in opening of the oxirane ring, with the epoxide oxygen becoming the hydroxy group and the adjacent carbon atoms carrying the alkoxy group $R^7O$ of the dihydroxy or polyhydroxy compound used for ring opening. In the reaction with the dihydroxy or polyhydroxy compound (IV), the free carboxyl group may be esterified or the terminal group —COOY in general formula (III) esterified with the substituent Y can be transesterified. If desired, the derivatives of the polyol fatty acids obtained, in which the carboxyl group is regularly esterified, are then saponified with bases of the general formula $M^{(+)}OH$, in which $M^{(+)}$ has the above-defined meanings of $Na^{(+)}$, $K^{(+)}$, $[R^1R^2R^3R^4N]^{n+}$, etc. or with an acid. In that case, the free polyol fatty acids corresponding to general formula (II) in which $M^{(+)}$ is the hydrogen ion or salts thereof corresponding to formula (II), in which $M^{(+)}$ is an alkali metal cation, such as $Na^{(+)}$ or $K^{(+)}$, or ammonium ion $[R^1R^2R^3R^4N]^{n+}$ with the above-defined meanings for $R^1$, $R^2$, $R^3$ and $R^4$ and also for n, are formed.

The unsaturated fatty acids corresponding to formula (III) and the dihydroxy or polyhydroxy compounds corresponding to formula (IV) are also understood to include unsaturated fatty acids containing more than one double bond and dihydroxy or polyhydroxy compounds of the type generally obtainable from commercially available oils and fats, such as for example soya oil, linseed oil, rapeseed oil, etc.

If desired, the polyl fatty acid or salt corresponding to general formula (II) obtained in this way is then mixed with other polyol fatty acids corresponding to the above general formula and wth one or more ammonium salts of fatty acids corresponding to general formula (I) in a ratio by weight of from 10:1 to 1:10 and preferably in a ratio by weight of 3:1 and, optionally, mixed with water.

The water-soluble mixtures according to the invention obtained in this way are eminently suitable for use as corrosion inhibitors in drilling oils, cutting oils, rolling oils, grinding oils, metal-cleaning solutions, coolants and lubricants. A surprising aspect of the use of these mixtures is that polyol fatty acids corresponding to general formula (II) and salts thereof do not as such show any corrosion-inhibiting properties. However, the compounds mentioned have a strong synergistic effect in combination with the ammonium salts of fatty acids corresponding to general formula (I) insofar as they distinctly increase their capacity to inhibit corrosion on metal surfaces. Thus, it is possible for example to reduce the concentration of the ammonium salts of fatty acids, which as such show corrosion-inhibiting properties, as known from the prior art, by up to 50% without in any way weakening the protection they afford against corrosion. Another advantage of the water-soluble mixtures according to the invention is that they generate very little foam and, in addition, produce none of the odor pollution encountered where the ammonium salts of fatty acids corresponding to general formula (I) are used on their own. In addition, the mixtures according to the invention show excellent solubility even in very hard water.

The invention will be illustrated but not limited by the following Examples.

EXAMPLE 1

Preparation of the potassium salt of a polyol fatty acid of general formula (II) ($R^6$=n-octyl, m=7, $R^7$=2,2-bis-(hydroxymethyl)-butyl, $M^{(+)}=K^{(+)}$).

670 g 1,1,1-tris-(hydroxymethyl)-propane (trimethylol propane), 1.5 g sulfuric acid and 1175 g epoxidized soya oil were heated with stirring for 1.5 hours to 100° C. After cooling to 50° C., an aqueous solution of 247 g KOH in 623 g water was added and the reaction mixture was heated for another 3 hours to 100° C. An 80% aqueous solution of the potassium salt of the polyol fatty acid (II) ($R^6$=n-octyl, m=7, $R^7$=2,2-bis-(hydroxymethyl)-butyl, $M^{(+)}=K^{(+)}$) was obtained in this way.

EXAMPLE 2

Preparation of the potassium salt of the polyol fatty acid (II) with $R^6$=n-octyl, m=7, $R^7$=2,3,-dihydroxypropyl, $M^{(+)}=K^{(+)}$.

920 g glycerol, 3.5 g sulfuric acid and 1758 g epoxidized oleic acid methyl ester were heated with stirring for 2 hours to 100° C. After cooling to 50° C., the heterogeneous reaction mixture was neutralized with a 30% solution of sodium methylate in methanol, the glycerol phase was separated off and the remaining phase was freed from approx. 200 g volatile constituents at 200° C./0.01 mbar. The distillation residue consisted of a light yellow oil.

712 g of this oil were heated for 3 hours at 100° C. with a solution of 80 g NaOH in 453 g of water. After cooling to 70° C., the reaction mixture was adjusted with sulfuric acid to a pH-value of 2, the aqueous phase was separated off and the organic phase was washed with water heated to 60° C. A polyol fatty acid (II) ($R^6$=n-octyl, m=7, $R^7$=2,3-dihydroxypropyl, $M^{(+)}=H^{(+)}$) was obtained in this way. 69.3 g of this polyol fatty acid were neutralized with 16.8 g of a 50% aqueous potassium hydroxide solution and diluted with 69.3 g deionized water.

EXAMPLE 3

Preparation of a corrosion-inhibiting mixture 53 g of the neutralization product of a mixture of 50% by weight caprylic acid and 50% by weight capric acid with di-n-butylamine were mixed with 100 g of the product of Example 1 and 60 g water.

EXAMPLE 4

Preparation of another corrosion-inhibiting mixture 50 g of the neutralization product of a mixture of 50% by weight caprylic acid and 50% by weight capric acid with di-n-butylamine were mixed with 150 g of the product of Example 2.

EXAMPLE 5

250 g trimethylol propane, 0.56 g concentrated sulfuric acid and 439 g epoxidized soya oil were heated with stirring for 1.5 hours to 100° C. After cooling to 90° C., 75 ml of a 50% aqueous sodium hydroxide solution were added to the reaction mixture, followed by saponification for 3 hours at 100° C. After cooling to 90° C., the reaction mixture was adjusted to pH 2 with 500 g 30% aqueous phosphoric acid, the aqueous phase was separated off and the remaining organic phase was washed with 2×40 ml water. The 622 g polyol fatty acid obtained in this way were neutralized with 131 g diethanolamine. The product was then diluted with 653.6 g deionized water.

EXAMPLE 6

150 g of the product prepared in accordance with Example 5 were mixed with 50 g of the neutralizate of 50% by weight caprylic acid and 50% by weight capric acid with di-n-butylamine.

EXAMPLE 7

Corrosion test according to DIN 51 360

The mixtures of Examples 3 and 4 were introduced into water varying in hardness in concentrations of 0.5 and 1% by weight, expressed as ammonium salt-polyol fatty acid mixture in the total quantity of water, completely dissolved and tested for their corrosion-inhibiting effect in the corrosion test according to DIN 51 360. The results are shown in Table 1 below.

The commercially available amine salt of a 1:1-mixture of caprylic acid and capric acid with di-n-butylamine, hereinafter referred to as "comparison product", was used for comparison. Its concentration in the in-use solution was 1 and 2% by weight, respectively.

The degree of corrosion on the tested sheets was evaluated using the following scale:

0=no corrosion
1=traces of corrosion
2=slight corrosion
3=moderate corrosion
4=serious corrosion

TABLE 1

Corrosion-inhibiting effect of mixtures according to the invention by comparison with a known inhibitor

| Prod. of Example | Concentration* (%) | Water hardness (° Germam H) 0 | 5 | 10 | 15 | 20 |
|---|---|---|---|---|---|---|
| 3 | 0.5 | 1 | 3 | 4 | 4 | 4 |
| | 1.0 | 0 | 0 | 0 | 0 | 1 |
| 4 | 0.5 | 3 | 4 | 4 | 4 | 4 |
| | 1.0 | 0 | 0 | 0 | 1 | 1 |
| 6 | 0.5 | 0 | 2 | 3 | 3 | 4 |
| | 1.0 | 0 | 0 | 0 | 0 | 0 |
| Comparison product | 1.0 | 1 | 3 | 4 | 4 | 4 |
| | 2.0 | 0 | 0 | 1 | 1–2 | 2 |

*based on the content of 1:1-mixture of caprylic acid and capric acid with di-n-butylamine Result:

In a concentration of 1% by weight, the products of Examples 3 and 4 according to the invention inhibit corrosion distinctly better than the comparison product, even in very hard water. Even when used in only half the concentration, the mixtures according to the invention still inhibit corrosion as effectively as the comparison product.

EXAMPLE 8

Foam test

Procedure: 50 ml of a test solution containing 3% of the mixtures of the invention were shaken 10 times in a 100 ml measuring cylinder, after which both the foam volume in ml. and the foam collapse time in mins. were measured. The results are shown in Table 2 below. The neutralization product of a 1:1 mixture of caprylic acid and capric acid with di-n-butylamine was again used for comparison.

TABLE 2

Foam test of mixtures according to the invention by comparison with a known inhibitor

| Prod. of Example | Concentration* (%) | Water hardness (° German H) 0** | 5** | 10** | 15** | 20** |
|---|---|---|---|---|---|---|
| Comparison product | 2 | 4/60 | 3/60 | 3/60 | 9/60 | 2/60 |
| 3 | 1 | 0/35 | 0/2 | 0/4 | 0/8 | 0/9 |
| 4 | 1 | 0/60 | 0/30 | 0/3 | 0/40 | 2/60 |
| 6 | 1 | 4/3 | 2/20 | 2/1 | 3/2 | 2/2 |

*based on the content of 1:1-mixture of caprylic and capric acid with di-n-butylamine
**first figure = foam volume (in ml)
second figure = foam collapse time (in mins)

Result:

Both the product of Example 4 and also the product of Example 3 show surprisingly fast foam collapse for amine soaps compared with the comparison product. Accordingly, the polyol fatty acid in the mixture according to the invention has a synergistic effect in regard to foam collapse in the products mentioned.

In addition, it was found that the products of Examples 3 and 4 are clearly superior to the comparison product in terms of odor pollution: whereas the comparison product has a decidedly unpleasant odor, no odor pollution is caused by the products of Examples 3 and 4.

What is claimed is:

1. A corrosion-inhibiting composition comprising (a) from about 10 to about 90% by weight of at least one ammonium salt of a fatty acid corresponding to the formula

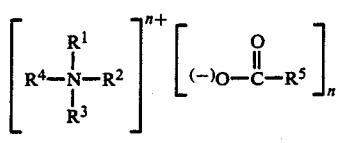

(I)

in which n=1 or 2; $R^1$, $R^2$, $R^3$ and $R^4$ can be the same or different and represent hydrogen, an unbranched or branched $C_1$–$C_6$ alkyl group, a $C_1$–$C_6$ hydroxyalkylene group, or a $C_1$–$C_8$ aminoalkylene group; and $R^5$ represents an unbranched or branched $C_6$–$C_{10}$ alkyl group; and (b) from about 10 to about 90% by weight of at least one polyol fatty acid or salt thereof corresponding to the formula

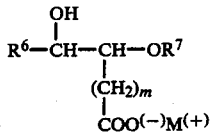

(II)

in which $R^6$ is a straight-chain or branched-chain $C_1$–$C_{19}$ alkyl or alkylene group; $R^7$ is an organic residue formed from a dihydroxy or polyhydroxy compound by elimination of a hydroxyl group; $M^{(+)}=H^{(+)}$, $Na^{(+)}$, $K^{(+)}$ or the ammonium ion $[R^1R^2R^3R^4N]^{n+}$ as defined in (a) above; and m is an integer of from 0 to 18;

wherein the quantities by weight are based on the total weight of components (a) and (b).

2. A corrosion-inhibiting composition according to claim 1 wherein in (a) n=1 and one of the substituents $R^1$ to $R^4$ is a $C_1$–$C_6$ alkyl group and the other substituents are hydrogen.

3. A corrosion-inhibiting composition according to claim 1 wherein in (a) n=1 and two of the substituents $R^1$ to $R^4$ represent a $C_3$ or $C_4$ alkyl group and the other two such substituents are hydrogen.

4. A corrosion-inhibiting composition according to claim 1 wherein in (a) n=1 and two of the substituents $R^1$ to $R^4$ represent n-butyl.

5. A corrosion-inhibiting composition according to claim 1 wherein in (a) n=2 and $M^{(+)}$ is (N,N-dimethyl-1,3-propylenediamine)$^{2+}$.

6. A corrosion-inhibiting composition according to claim 1 wherein in (a) $R^5$ represents i-heptyl, i-octyl, n-octyl, i-nonyl or n-decyl.

7. A corrosion-inhibiting composition according to claim 1 wherein in (a) two compounds of formula (I) are present in a ratio by weight of about 1:1.

8. A corrosion-inhibiting composition according to claim 7 wherein component (a) is a neutralization product of caprylic acid and di-n-butylamine and capric acid and di-n-butylamine.

9. A corrosion-inhibiting composition according to claim 1 wherein from about 10 to about 50% by weight of component (a) and from about 50% to about 90% by weight of component (b) are present.

10. A corrosion-inhibiting composition according to claim 1 wherein in component (b) $R^6$ is a straight-chain $C_8$–$C_{15}$ alkyl group.

11. A corrosion-inhibiting composition according to claim 1 wherein in component (b) m=8 to 14.

12. A corrosion-inhibiting composition according to claim 1 wherein in component (b) $R^6$ is n-octyl and m=7.

13. A corrosion-inhibiting composition according to claim 1 wherein in component (b) $R^7$ is an organic residue formed by elimination of a hydroxyl group from one of the following compounds: ethylene glycol, glycerol, diglycerol, propylene glycol, diethylene glycol, dipropylene glycol, trimethylol ethane, trimethylol propane, neopentyl glycol, pentaerythritol, dipentaerythritol, sorbitol, sorbitan, diethanolamine, triethanolamine, polyethylene glycol ($H(OCH_2CH_2)_nOH$ with n=1–10), polypropylene glycol

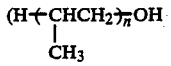

with n=1–10), propylene oxide-ethylene oxide block polymers corresponding to the formula

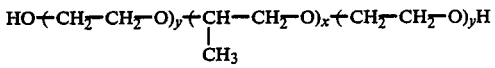

with $x+y=2$ to 10 and ethylene oxide-propylene oxide block polymers corresponding to the formula

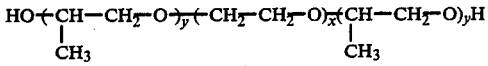

with $x+y=2$ to 10.

14. In a drilling oil, cutting oil, rolling oil, grinding oil, metal-cleaning solution, coolant, or lubricant, the improvement comprising the presence therein of a corrosion-inhibiting quantity of the composition of claim 1.

15. A method for inhibiting corrosion of ferrous based metal substrates comprising contacting said substrate with a corrosion-inhibiting quantity of the composition of claim 1.

* * * * *